US011429048B2

(12) United States Patent
Hirajima et al.

(10) Patent No.: US 11,429,048 B2
(45) Date of Patent: Aug. 30, 2022

(54) IMAGE FORMING APPARATUS THAT CAN FORM IMAGES ON BOTH SIDES OF SHEET BY INVERTING SHEET

(71) Applicant: CANON KABUSHIKI KAISHA, Tokyo (JP)

(72) Inventors: Marehiko Hirajima, Kanagawa (JP); Shimpei Ishikawa, Kanagawa (JP); Keisuke Fujita, Kanagawa (JP); Junichi Sekiyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/182,577

(22) Filed: Feb. 23, 2021

(65) Prior Publication Data

US 2021/0271195 A1 Sep. 2, 2021

(30) Foreign Application Priority Data

Feb. 27, 2020 (JP) ..... JP2020-032188

(51) Int. Cl.
*G03G 15/23* (2006.01)
*G03G 15/00* (2006.01)

(52) U.S. Cl.
CPC ..... *G03G 15/234* (2013.01); *G03G 15/505* (2013.01); *G03G 2215/2083* (2013.01)

(58) Field of Classification Search
CPC combination set(s) only.
See application file for complete search history.

(56) References Cited

U.S. PATENT DOCUMENTS

2001/0031155 A1* 10/2001 Hashimoto ..... G03G 15/6552 399/130
2003/0231914 A1* 12/2003 Yasui ..... G03G 15/231 399/401
2006/0269339 A1* 11/2006 Okamoto ..... G03G 15/6564 399/401
2017/0371288 A1* 12/2017 Hashimoto ..... G03G 15/6552

FOREIGN PATENT DOCUMENTS

JP 07-021466 Y2 5/1995
JP 08-314203 A 11/1996
JP 2011-025489 A 2/2011
JP 5779960 B 9/2015

* cited by examiner

*Primary Examiner* — Jennifer Bahls
(74) *Attorney, Agent, or Firm* — Venable LLP

(57) ABSTRACT

A transmission unit transmits driving force to be supplied from a motor to a roller pair. A switching unit acts on the transmission unit to switch a rotation direction of the roller pair by the driving force between a normal rotation and a reverse rotation. A control unit controls a rotation speed of the motor to convey the sheet at a second conveyance speed in a part of a first time period. The second conveyance speed is lower than a first conveyance speed. The first conveyance speed is a conveyance speed when the sheet is conveyed in the image forming unit. In the first time period the sheet having the image formed on the first surface is conveyed in a first direction. In a second time period the sheet is conveyed in a second direction.

14 Claims, 8 Drawing Sheets

IMAGE FORMING APPARATUS THAT CAN FORM IMAGES ON BOTH SIDES OF SHEET BY INVERTING SHEET

BACKGROUND OF THE INVENTION

Field of the Invention

The present invention relates to an image forming apparatus that can form images on both sides of a sheet by inverting the sheet.

Description of the Related Art

An image forming apparatus, which can print on both sides, forms an image on the front surface of a sheet, inverts the front and back of the sheet by an inversion mechanism, and forms an image on the back surface of the sheet. Japanese Patent No. 5779960 proposes an inversion mechanism for rotating a sheet along a rotation axis parallel to a sheet conveyance direction in order to invert the front and back of the sheet inside the image forming apparatus.

Unlike the inversion mechanism that rotates the sheet as described in Japanese Patent No. 5779960, an inversion mechanism for inverting the front and back of the sheet by switching back the sheet is known. In order to implement the switchback, a gear mechanism and a solenoid are required to switch a rotation direction of a conveying roller pair between a normal rotation and a reverse rotation. In order to reduce the size of the image forming apparatus, the switchback of the sheet may be implemented by pulling a trailing end of the sheet from a main conveyance path to a sub conveyance path while protruding a leading end of the sheet from a discharge port. Here, when a sheet conveyance speed is high, the conveying roller pair cannot be switched from the normal rotation to the reverse rotation in time, and the sheet is discharged from the discharge port, and the switchback may fail. In particular, the inversion mechanism in which the gear and the solenoid are used requires a switching time, which can cause this problem. In order to prevent such an inversion error, it is conceivable to increase the length of the conveyance path for the switchback. However, in this case, the size of the image forming apparatus becomes large.

SUMMARY OF THE INVENTION

The present invention provides an image forming apparatus comprising: a main conveyance path configured to convey a sheet; an image forming unit configured to form images on a first surface and a second surface of the sheet to be conveyed on the main conveyance path; a switchback unit provided at an end portion of the main conveyance path and configured to switch back the sheet having the image formed on the first surface by a roller pair; a sub conveyance path configured to convey the switched back sheet to the main conveyance path in order to form the image on the second surface of the sheet; a motor configured to be controlled to drive the roller pair provided in the switchback unit and to rotate in only one direction; a transmission unit configured to transmit driving force to be supplied from the motor to the roller pair; a switching unit configured to act on the transmission unit to switch a rotation direction of the roller pair by the driving force between a normal rotation and a reverse rotation; and a control unit configured to control a rotation speed of the motor to convey the sheet, wherein the sheet having the image formed on the first surface by the image forming unit is conveyed in a first direction by the roller pair in a first time period, and the sheet is conveyed in a second direction different from the first direction by the roller pair in a second time period, the control unit changes the rotation speed from a first rotation speed to a second conveyance speed so that the sheet is conveyed at the second rotation speed in a part of the first time period, the second conveyance speed is lower than the first conveyance speed, and the first conveyance speed is a conveyance speed when the sheet is conveyed in the image forming unit.

Further features of the present invention will become apparent from the following description of exemplary embodiments (with reference to the attached drawings).

DESCRIPTION OF THE EMBODIMENTS

Figure 1:
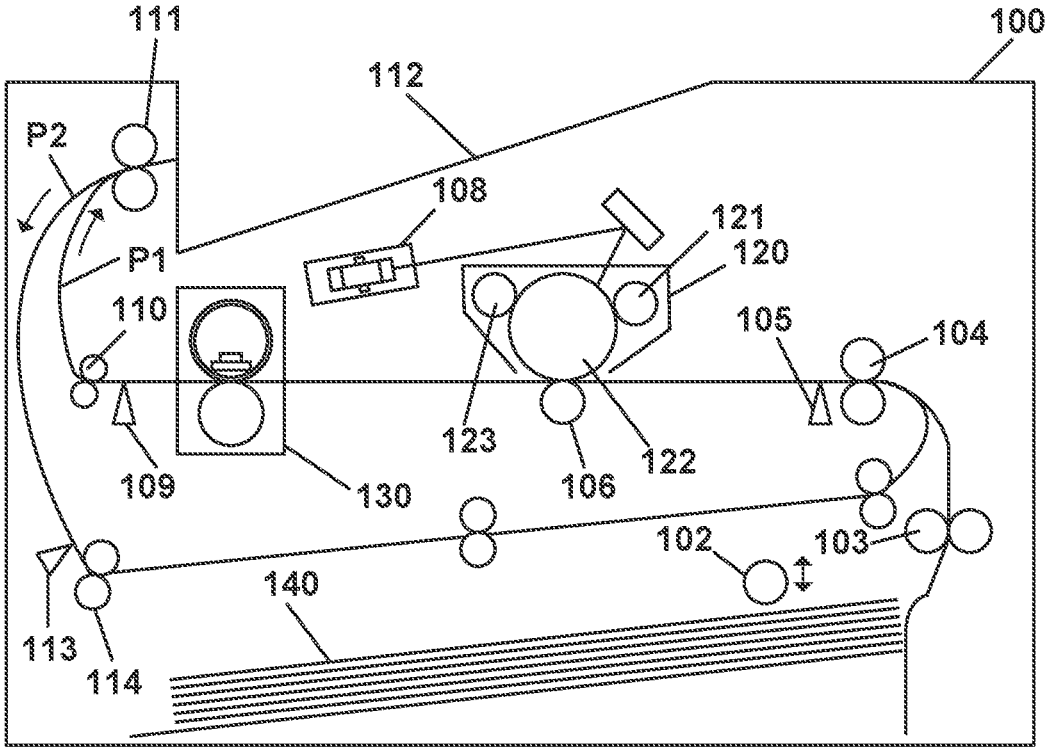
FIG. 1 is a schematic configuration diagram of an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

Image Forming Apparatus

As illustrated in FIG. 1, an image forming apparatus 100 is an electrophotographic printer. Here, an electrophotographic method is exemplified as an image forming method, but the present invention can be applied to any image forming method. For example, the present invention can be applied to various methods such as an ink jet recording method and a thermal transfer method.

A replaceable cartridge 120 includes a photosensitive drum 122, a charging roller 123, and a developing roller 121. The photosensitive drum 122 rotates clockwise at a predetermined peripheral speed (process speed). The charging roller 123 uniformly charges a peripheral surface of the photosensitive drum 122. An exposure device 108 emits light in accordance with an image signal on the photosensitive drum 122 to form an electrostatic latent image. The developing roller 121 develops the electrostatic latent image using toner to form a toner image.

A feeding roller 102 feeds sheets accommodated in a sheet cassette 140 one by one to a conveyance path. A conveying roller pair 103 and a registration roller pair 104 are conveying roller pairs that convey each sheet to a transfer unit. The transfer unit includes the photosensitive drum 122 and a transfer roller 106. When the sheet passes the transfer unit, the toner image is transferred from the photosensitive drum 122 to the sheet. A fixing device 130 fixes the toner image on the sheet by applying heat and pressure to the sheet and the toner image. A discharging roller pair 110 conveys the sheet that has passed the fixing device 130 to an FD roller pair 111. FD is an abbreviation for face down. FD is a term derived from the fact that the sheet is discharged with the first surface on which the toner image is formed facing downward.

The FD roller pair 111 discharges the sheet on which image formation has been completed to the FD tray 112. In double-sided image formation, the FD roller pair 111 inverts the front and back of the sheet having the image formed on the first surface, by a switchback method. Specifically, the FD roller pair 111 discharges a portion from a leading end to the middle of the sheet conveyed on a main conveyance path P1 to the outside of the image forming apparatus 100. At this time, the FD roller pair 111 normally rotates. When a trailing end of the sheet reaches a position where the trailing end of the sheet can be fed into the sub conveyance path P2, the rotation direction of the FD roller pair 111 is switched from the normal rotation to the reverse rotation, and the sheet is fed into the sub conveyance path. Since the sheet is switched back by the FD roller pair 111, such an inversion method is referred to as the switchback method. As described above, the FD roller pair 111 is a conveying roller pair that functions not only as a discharging roller pair but also as an inverting roller pair.

The sub conveyance path P2 is a conveyance section extending from the FD roller pair 111 to the registration roller pair 104. A plurality of conveying roller pairs 114 are disposed in the sub conveyance path P2. These conveying roller pairs 114 convey the sheet toward the registration roller pair 104. The registration roller pair 104 conveys the sheet to the transfer unit again. The transfer unit transfers a toner image to a second surface of the sheet. The fixing device 130 fixes the toner image on the second surface of the sheet. The discharging roller pair 110 transfers the sheet to the FD roller pair 111. By continuing normal rotation, the FD roller pair 111 discharges the sheet having the images formed on both sides to the FD tray 112.

A plurality of sheet sensors (e.g., a registration sensor 105 and a fixing discharging sensor 109) are provided on the main conveyance path P1. One or more sheet sensors (inversion sensors 113) are provided on the sub conveyance path P2. These sheet sensors are generally utilized for determining whether the sheet is normally conveyed, deciding the timing of image formation, and the like.

Controller

Figure 2A:
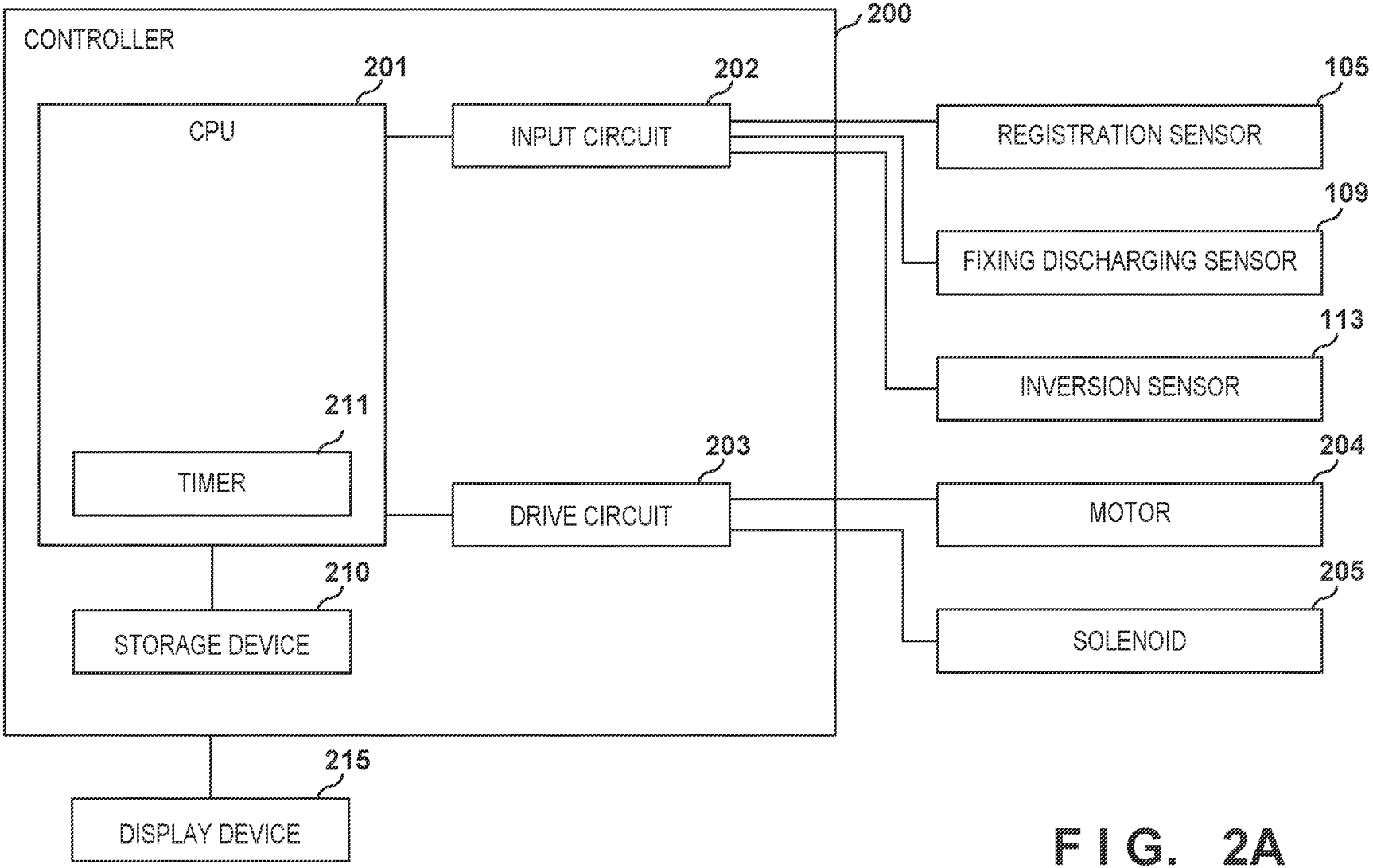
FIGS. 2A and 2B are block diagrams illustrating a controller.

FIG. 2A illustrates a controller 200 for controlling the image forming apparatus 100. A CPU 201 controls each unit of the image forming apparatus 100 by executing a control program stored in a ROM area of a storage device 210. An input circuit 202 receives detection signals outputted from the registration sensor 105, the fixing discharging sensor 109, and the inversion sensor 113, and transfers the received signals to the CPU 201. A drive circuit 203 generates a drive current for driving a motor 204 and generates a drive current for driving a solenoid 205. In the present embodiment, the motor 204 is a motor that rotates in only one direction. Further, the motor 204 drives to rotate the feeding roller 102, the conveying roller pair 103, the registration roller pair 104, the photosensitive drum 122, the transfer roller 106, the fixing device 130, the discharging roller pair 110, and the FD roller pair 111. Of these, the FD roller pair 111 executes the normal rotation and the reverse rotation in order to switch back the sheet. The solenoid 205 drives a gear mechanism that transmits the driving force supplied from the motor 204 to the FD roller pair 111 to switch the rotation direction of the FD roller pair 111. A display device 215 notifies the user of, for example, a sheet jam.

Figure 2B:
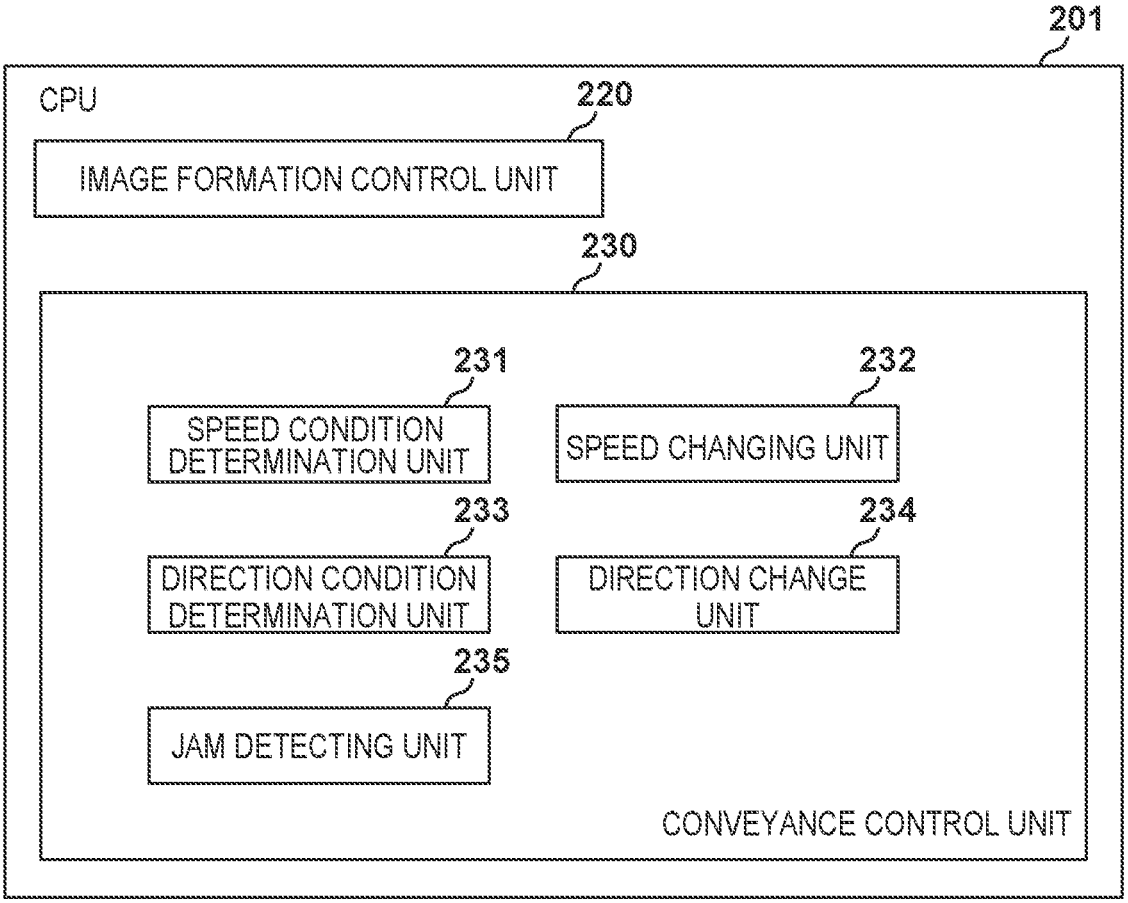

FIG. 2B illustrates functions implemented by the CPU 201 executing a control program. Some or all of the plurality of functions may be implemented by hardware such as an application specific integrated circuit (ASIC) or a field programmable gate array (FPGA).

An image formation control unit 220 controls image formation executed by the image forming apparatus 100. The image formation control unit 220 controls charging voltage, developing voltage, and fixing voltage, controls light emission intensity of the exposure device 108, controls rotation speed of a rotary polygon mirror in the exposure device 108, controls fixing temperature of the fixing device 130, and the like. For example, the image formation control unit 220 controls the start timing of exposure by the exposure device 108 based on the detection result by the registration sensor 105.

A conveyance control unit 230 controls the conveying processing of the sheet. A speed condition determination unit 231 determines whether a condition for changing the sheet conveyance speed (speed change condition) is satisfied. When the speed change condition is satisfied, the speed condition determination unit 231 instructs a speed changing unit 232 to change the conveyance speed (rotation speed of the motor 204). The speed changing unit 232 controls the rotation speed of the motor 204 in accordance with the speed change instruction. Specific examples of the speed change condition will be described later.

A direction condition determination unit 233 determines whether a condition (direction change condition) for changing the sheet conveyance direction (rotation direction of the FD roller pair 111) is satisfied. When the direction change condition is satisfied, the direction condition determination unit 233 instructs a direction change unit 234 to change the conveyance direction. The direction change unit 234 controls the solenoid 205 in accordance with the instruction. Specific examples of the direction change condition will be described later. A jam detecting unit 235 detects a sheet jam based on the detection result of the fixing discharging sensor 109 or the inversion sensor 113.

Front and Back Inversion Mechanism

Figure 3:
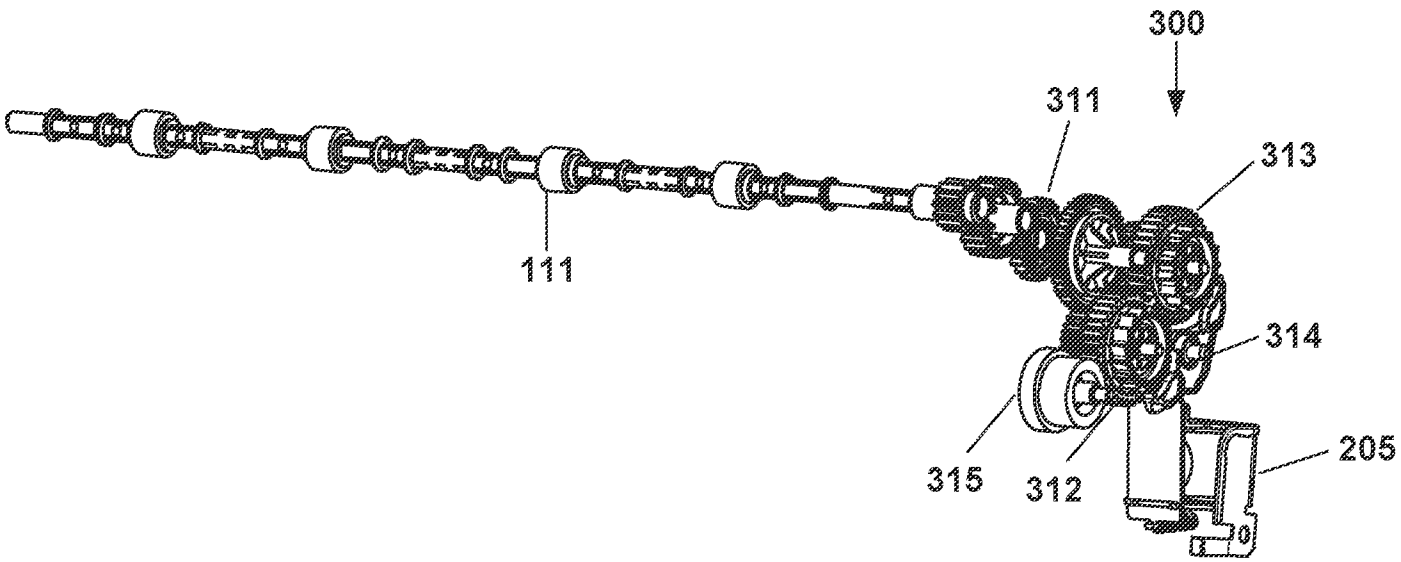
FIG. 3 is a diagram illustrating a front and back inversion mechanism.

FIG. 3 illustrates an example of an inversion mechanism 300 using the solenoid 205. The FD roller 111 is connected to an idler gear 311. In this example, a gear is provided on the end portion of the rotating shaft of the FD roller 111, and the idler gear 311 meshes with the gear. The idler gear 311 may be composed of a plurality of gears. With this configuration, the FD roller 111 rotates by the driving force transmitted from the idler gear 311.

The idler gear 311 is connected to a planetary gear 312 and a planetary gear 313. The drive force supplied from the motor 204 is connected to the planetary gear 312 via an input gear 315. When the CPU 201 turns off the solenoid 205 via the drive circuit 203, a switching lever 314 meshes with the planetary gear 312. Thus, the FD roller pair 111 rotates in the normal direction (the direction in which the sheet is discharged to the outside of the image forming apparatus 100). On the other hand, when the CPU 201 turns on the solenoid 205 via the drive circuit 203, the switching lever 314 meshes with the planetary gear 313. Thus, the FD roller pair 111 rotates in the reverse direction (the direction in which the sheet is returned to the inside of the image forming apparatus 100). In the mechanism for switching the normal rotation and reverse rotation by the switching lever 314, there are variations in the response of the solenoid 205 and variations in the operation of the switching lever 314. The time from when the solenoid 205 is turned on until the switching lever 314 completes the switching operation has a variation of about several tens of milliseconds. In conjunction with this, the position of the trailing end of the sheet (inversion position) when the sheet conveyance direction is inverted also varies. Due to the market demand for the image forming apparatus 100, the sheet conveyance speed increases. The faster the conveyance speed, the greater the variation in the inversion position. When the inversion position is downstream of the FD roller pair 111 in the sheet conveyance direction, the FD roller pair 111 cannot invert the sheet. Even though no image is formed on the second surface, the sheet is discharged to the FD tray 112. Accordingly, the CPU 201 needs to drive the solenoid 205 at an appropriate timing.

Flowchart

Figure 4:
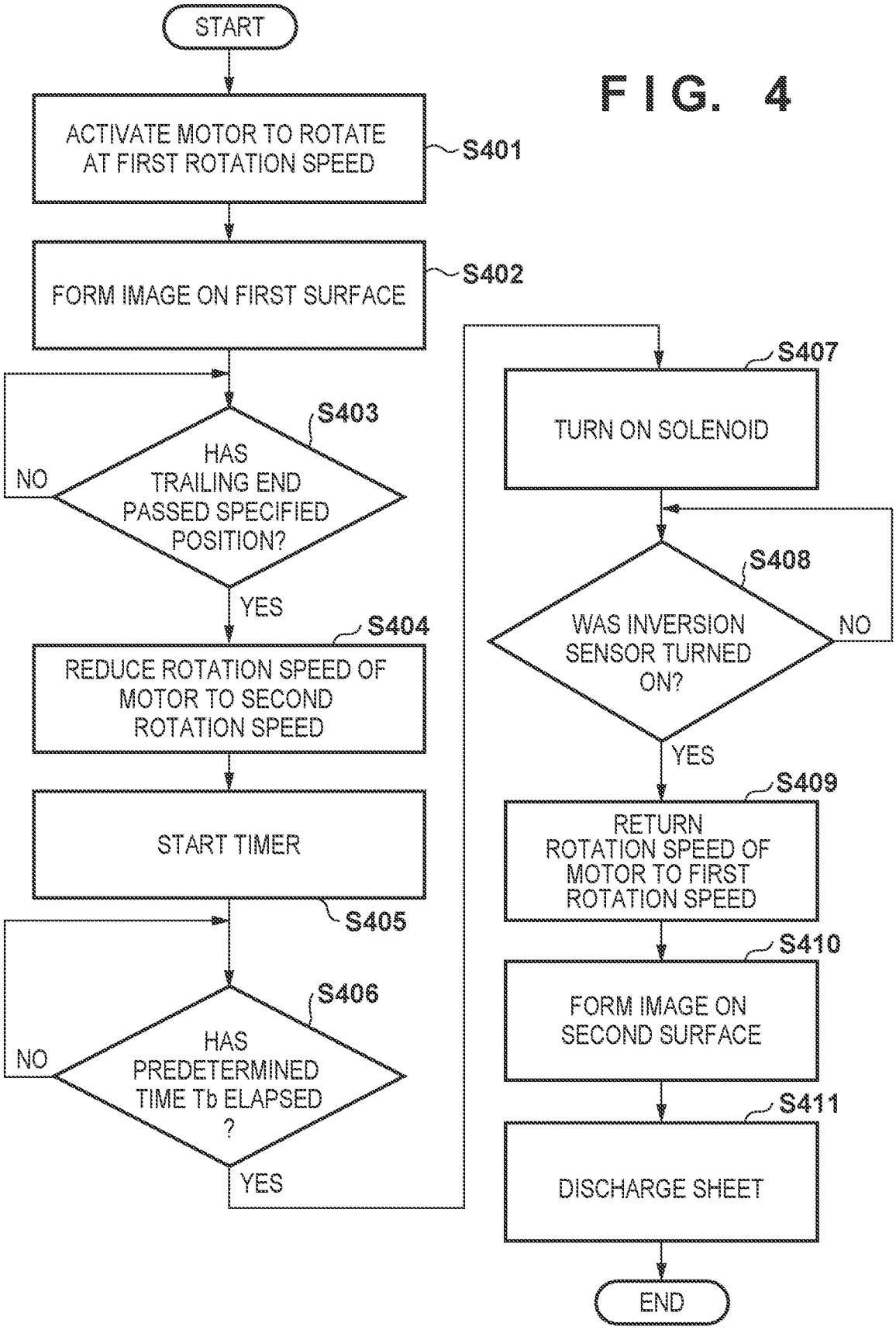
FIG. 4 is a flowchart illustrating an image forming method.

FIG. 4 illustrates a method for controlling the image forming apparatus 100 executed by the CPU 201 according to a control program. Here, it is assumed that a double-sided printing job has been inputted.

In S401, the CPU 201 (conveyance control unit 230) activates the motor 204 to rotate the motor 204 at a first rotation speed. The first rotation speed is a rotation speed corresponding to the so-called image forming speed (process speed). As a result, the peripheral speeds of the various rollers driven by the motor 204 are maintained at a first conveyance speed (process speed).

In S402, the CPU 201 (image formation control unit 220) controls the image forming apparatus 100 so that an image is formed on the first surface of the sheet. The CPU 201 charges the photosensitive drum 122 with the charging roller 123, and supplies the image signal to the exposure device 108 to form the electrostatic latent image. Further, the CPU 201 controls the developing roller 121 to develop the electrostatic latent image to form the toner image. Additionally, the CPU 201 controls the feeding roller 102 to feed the sheet. For example, the CPU 201 lowers the feeding roller 102 by the solenoid (not illustrated) to bring the feeding roller 102 into contact with the sheet. As a result, the sheet is fed into the conveyance path. The CPU 201 controls the exposure start timing of the exposure device 108 with reference to the time point at which the registration sensor 105 detects the leading end of the sheet. As a result, the toner image is transferred to an appropriate position on the sheet. The CPU 201 controls the fixing device 130 to fix the toner image on the first surface.

In S403, the CPU 201 (speed condition determination unit 231) determines whether the trailing end of the sheet has passed a specified position based on the detection result of the fixing discharging sensor 109. For example, when the detection result switches from on to off, the CPU 201 determines that the trailing end of the sheet has passed the detection position of the fixing discharging sensor 109. Here, on means that the sheet is passing, and off means that the sheet is not passing. The fixing discharging sensor 109 is disposed downstream of the fixing device 130 in the sheet conveyance direction. That is, the fixing discharging sensor 109 is disposed between the discharging roller pair 110 and the fixing device 130. The fixing discharging sensor 109 is a sheet sensor for confirming that the trailing end of the sheet has passed the fixing device 130. Therefore, the fixing discharging sensor 109 may be disposed between the fixing device 130 and the FD roller pair 111 in the main conveyance path P1. When the trailing end of the sheet passes the specified position, the CPU 201 proceeds to S404.

In S404, the CPU 201 (speed changing unit 232) reduces the rotation speed of the motor 204 from the first rotation speed to a second rotation speed. The second rotation speed is, for example, 50% of the first rotation speed. The sheet is conveyed at a second conveyance speed (50% of the first conveyance speed) corresponding to the second rotation speed.

In S405, the CPU 201 (direction condition determination unit 233) starts a timer 211. S404 and S405 may be replaced. The timer 211 may be implemented by a counter circuit of the count-up type or a counter circuit of the count-down type.

In S406, the CPU 201 (direction condition determination unit 233) determines whether a predetermined time Tb has elapsed from a time point at which the rotation speed was changed, based on the measurement result by the timer 211. When the elapsed time measured by the timer 211 becomes equal to or greater than the predetermined time Tb, the CPU 201 proceeds to S407. Here, the predetermined time Tb is the time required for the trailing end of the sheet to reach the inversion position where the trailing end of the sheet can be pulled from the main conveyance path P1 to the sub conveyance path P2.

In S407, the CPU 201 (direction change unit 234) turns on the solenoid 205 via the drive circuit 203. As a result, the inversion mechanism 300 operates, and the rotation direction of the FD roller pair 111 is changed from the normal rotation to the reverse rotation. As a result, the sheet is guided to the sub conveyance path P2, and is conveyed on the sub conveyance path P2.

In S408, the CPU 201 (speed condition determination unit 231) determines whether the inversion sensor 113 is turned on. That is, the CPU 201 determines whether the leading end of the sheet has reached the detection position of the inversion sensor 113 based on the detection result of the inversion sensor 113. When the inversion sensor 113 is turned on, the CPU 201 proceeds to S409.

In S409, the CPU 201 (speed changing unit 232) returns (increases) the rotation speed of the motor 204 from the second rotation speed to the first rotation speed via the drive circuit 203. As a result, the sheet conveyance speed returns to the first conveyance speed. Note that when the inversion sensor 113 is turned off (when the trailing end of the sheet passes the inversion sensor 113), the CPU 201 switches the solenoid 205 to off. As a result, the inversion mechanism 300 operates, and the rotation direction of the FD roller pair 111 is switched from the reverse rotation to the normal rotation. The sheet is again transferred to the registration roller pair 104 and further conveyed to the transfer unit.

In S410, the CPU 201 (image formation control unit 220) controls the image forming apparatus 100 to form a toner image on the second surface of the sheet. In S411, the CPU 201 (conveyance control unit 230) controls the image forming apparatus 100 to discharge the sheet having the images formed on both sides to the FD tray 112. Since the solenoid 205 is maintained off in S411, the FD roller pair 111 continues to rotate in the normal direction.

Figure 5:
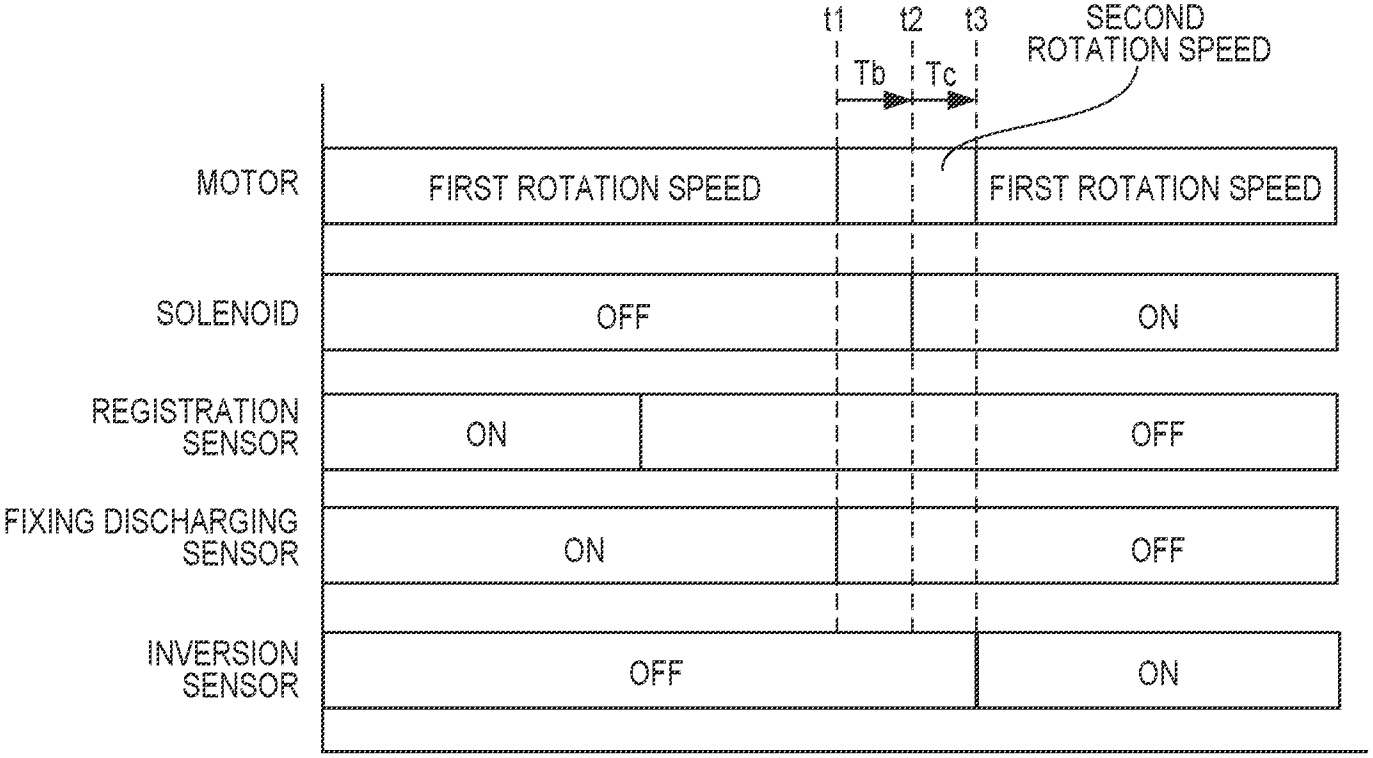
FIG. 5 is a timing chart illustrating control timing.

FIG. 5 is a timing chart for explaining the inversion timing. The time t1 is a time point at which the trailing end has passed the specified position at S403, and a time point at which the fixing discharging sensor 109 is switched from on to off. At the time t1, the rotation speed of the motor 204 is changed from the first rotation speed (normal speed) to the second rotation speed (low speed). Note that the solenoid 205 is off at the time t1. The registration sensor 105 is also off. The inversion sensor 113 is also off.

The time t2 is a time at which the predetermined time Tb has elapsed from the time t1. The time t2 is a time at which a condition relating to the predetermined time Tb is satisfied in S406. At the time t2, the solenoid 205 is turned on, and the sheet conveyance direction is inverted. At the time t2, the rotation speed of the motor 204 is the second rotation speed.

The time t3 is a time at which the leading end of the sheet is detected by the inversion sensor 113 at S408. At the time t3, the rotation speed of the motor 204 is changed from the second rotation speed to the first rotation speed.

In the first embodiment, the rotation speed of the motor 204 has returned from the second rotation speed to the first rotation speed on condition that the inversion sensor 113 is turned on. However, the CPU 201 may change the rotation speed of the motor 204 when a predetermined time Tc has elapsed from the time t2, which is the time point at which the solenoid 205 is turned on. As illustrated in FIG. 5, the predetermined time Tc is a time from the time t2 to the time t3. The predetermined times Tb and Tc are decided in advance by experiments or simulations, are stored in the ROM area of the storage device 210, and are read out by the CPU 201 for use.

In the first embodiment, the second rotation speed is defined as half of the first rotation speed, but this is merely an example. The second rotation speed may be determined in accordance with the length of a sheet inversion unit including the FD roller pair 111, and the image formation speed. That is, the second rotation speed may be any conveyance speed that enables the sheet to be reliably pulled from the main conveyance path P1 to the sub conveyance path P2 before being accidentally discharged to the FD tray 112. By switching the rotation speed of the motor 204 to the low speed in this manner, the distance to be conveyed before the sheet is inverted is shortened. As a consequence, it is possible to reduce the size of the inversion unit of the image forming apparatus 100 while maintaining a good front and back inversion operation. That is, even when the switchback method is employed in which a part of the sheet is discharged to the outside of the image forming apparatus 100 to invert the sheet conveyance direction, the front and back sides of the sheet can be satisfactorily inverted. In addition, when the inversion of the sheet is completed, the sheet conveyance speed is increased, so that the time required to form the images on both sides of the sheet is not so long. That is, the productivity and usability of the image forming apparatus 100 are maintained.

Second Embodiment

In the first embodiment, deceleration of the motor 204 is triggered by the time point at which the fixing discharging sensor 109 is turned off. However, any trigger that can produce the same effects as those of the first embodiment can be employed in the present invention. Thus, in a second embodiment, the motor 204 is decelerated with the lapse of a predetermined time Td after the registration sensor 105 is turned off as a trigger. The same reference numerals are given to the items common to those in the first embodiment in the second embodiment, and descriptions thereof are omitted.

Figure 6:
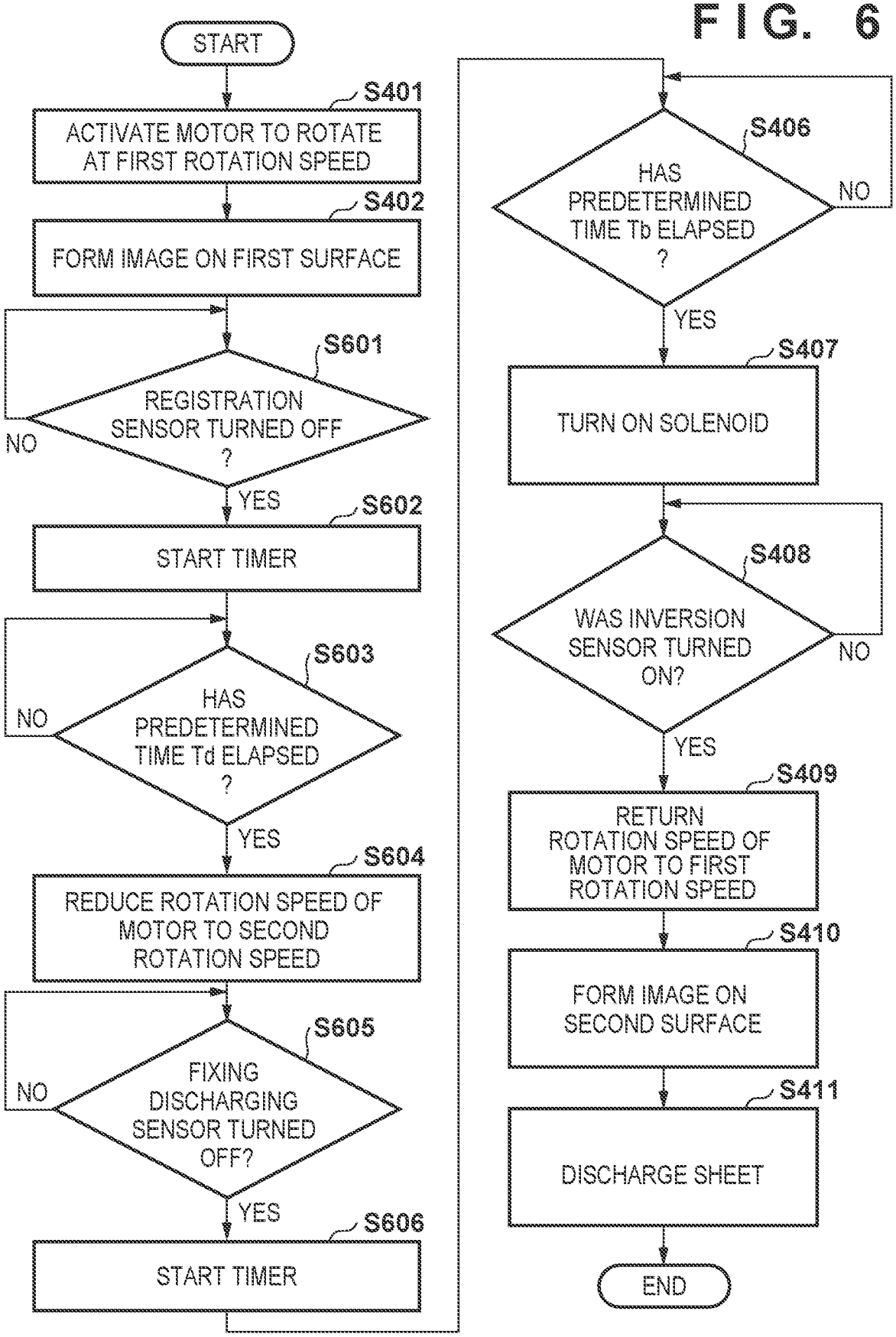
FIG. 6 is a flowchart illustrating an image forming method of a second embodiment.

FIG. 6 is a flowchart illustrating an image forming process of the second embodiment. As described above, the motor 204 is activated in S401 and the image formation on the first surface is initiated in S402. The CPU 201 then proceeds to S601.

In S601, the CPU 201 (speed condition determination unit 231) determines whether the detection signal of the registration sensor 105 is turned off. That is, the CPU 201 determines whether the trailing end of the sheet has passed the detection position of the registration sensor 105. When the trailing end of the sheet passes the detection position of the registration sensor 105, the CPU 201 proceeds to S602.

In S602, the CPU 201 (speed condition determination unit 231) starts the timer 211. In S603, the CPU 201 (speed condition determination unit 231) determines whether the predetermined time Td has elapsed from a time point at which the trailing end of the sheet has passed the detection position of the registration sensor 105. The predetermined time Td is a time required for the trailing end of the sheet to be conveyed from the detection position of the registration sensor 105 to a nip section of the fixing device 130. That is, S603 is a process for determining whether the trailing end of the sheet has reached the nip section of the fixing device 130. When the predetermined time Td has elapsed, the CPU 201 proceeds to S604. In S604, the CPU 201 (speed changing unit 232) reduces the rotation speed of the motor 204 from the first rotation speed to the second rotation speed.

In S605, the CPU 201 (direction condition determination unit 233) determines whether the fixing discharging sensor 109 is turned off. That is, the CPU 201 determines whether the trailing end of the sheet has passed the detection position of the fixing discharging sensor 109. When the detection signal of the fixing discharging sensor 109 is turned from on to off, the CPU 201 proceeds to S606.

In S606, the CPU 201 (direction condition determination unit 233) starts the timer 211 in order to measure the predetermined time Tb. The CPU 201 then executes S406 to S411.

Figure 7:
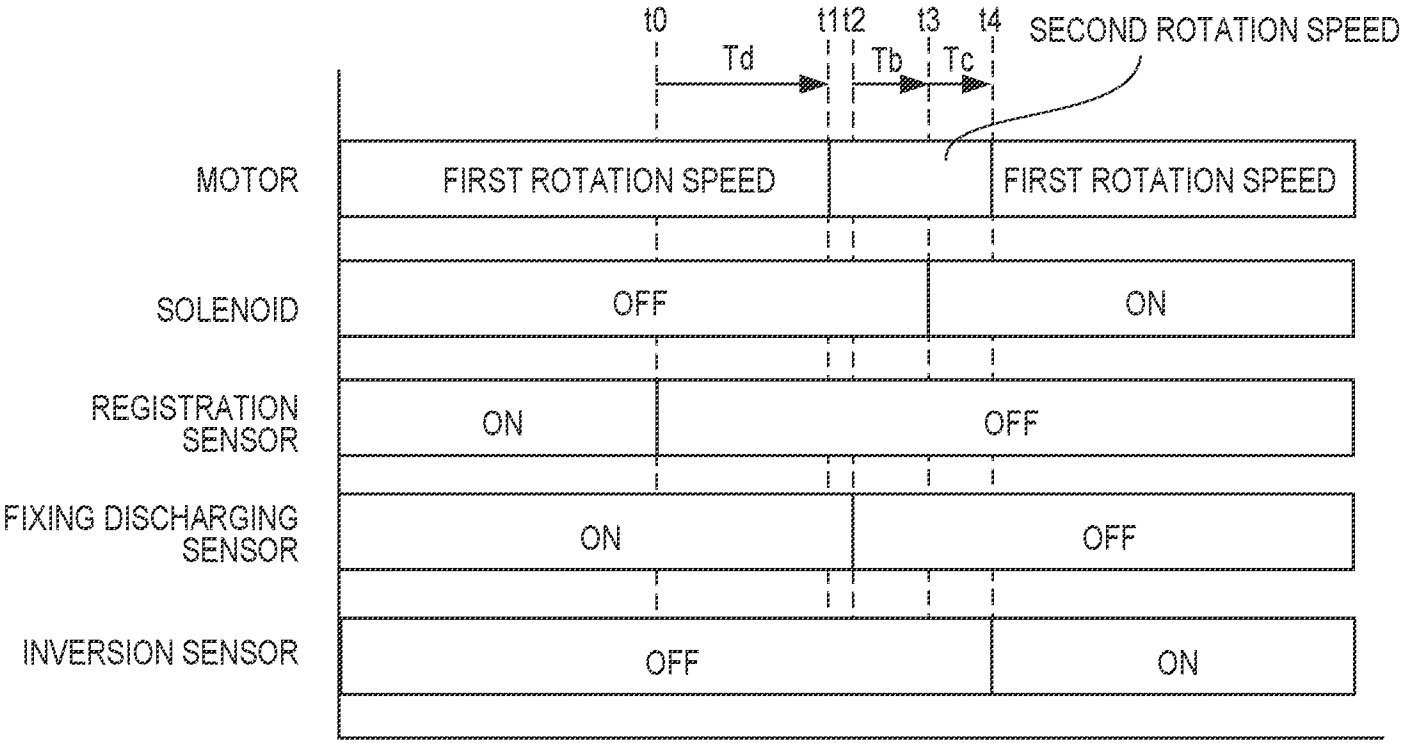
FIG. 7 is a timing chart illustrating control timing of the second embodiment.

FIG. 7 is a timing chart for explaining the inversion timing. In this example, the time t0 is a time at which the detection signal of the registration sensor 105 switches from on to off. The time t1 is a time at which the predetermined time Td has elapsed from the time to. At the time t1, the rotation speed of the motor 204 is changed from the first rotation speed to the second rotation speed.

The time t2 is a time point at which the detection signal of the fixing discharging sensor 109 switches from on to off. At the time t2, the timer 211 restarts to measure the predetermined time Tb. The time t3 is a time point at which the predetermined time Tb has elapsed from the time t2. At the time t3, the solenoid 205 is turned on. The time t4 is a time point at which the detection signal of the inversion sensor 113 switches from off to on. At the time t4, the rotation speed of the motor 204 is changed from the second rotation speed to the first rotation speed.

The predetermined time Td may be calculated from the following equation.

$$Td = Lrf/Vp(\text{sec}) \quad (1)$$

Here, Lrf is a distance (mm) from the detection position of the registration sensor 105 to the center of the nip section of the fixing device 130. Vp is the first conveyance speed (mm/sec) corresponding to the first rotation speed.

As described in the second embodiment, the rotation speed of the motor 204 may be changed by triggering the elapse of the predetermined time Td from the time point at which the registration sensor 105 is turned off. As a result, in the second embodiment, the distance that the sheet is conveyed before the sheet is inverted will be shortened as compared with the first embodiment. Other effects and modifications of the second embodiment are as described in the first embodiment.

Technical Ideas Derived from Exemplary Embodiments

Viewpoint 1

The main conveyance path P1 is an example of a main conveyance path for conveying a sheet. The photosensitive drum 122 and the transfer roller 106 are examples of an image forming unit that forms images on a first surface and a second surface of the sheet conveyed on the main conveyance path P1. The FD roller pair 111 functions as a switchback unit provided at an end portion of the main conveyance path P1 and configured to switch back the sheet having the image formed on the first surface by a roller pair. The sub conveyance path P2 functions as a sub conveyance path for conveying the switched back sheet to the main conveyance path in order to form the image on the second surface of the sheet. Note that a flapper may be adopted between the main conveyance path P1 and the sub conveyance path P2 to guide the sheet to be conveyed by the reversely rotating FD roller pair 111 to the sub conveyance path P2. Note that when an inlet port of the sub conveyance path P2 is provided above the main conveyance path P1, the flapper may be omitted. This is because when the vicinity of a trailing end of the sheet is nipped by the FD roller pair 111, a leading end side of the sheet becomes heavier and the trailing end side of the sheet tends to face upward, with respect to the FD roller pair 111 (see-saw phenomenon). The motor 204 is an example of a motor that is controlled to drive the roller pair provided in the switchback unit and to rotate in only one direction. A motor that drives a plurality of rollers provided in the main conveyance path P1, such as the motor 204, is basically driven to rotate in only one direction. The inversion mechanism 300 is an example of a transmission unit that transmits the driving force supplied from the motor 204 to the rollers. The solenoid 205 functions as a switching unit that acts on the transmission unit to switch the rotation direction of the roller pair by the driving force, between the normal rotation and the reverse rotation. The CPU 201 is an example of a control unit. The time period before the time t2 illustrated in FIG. 5 or the time t3 illustrated in FIG. 7 is an example of a first time period in which the sheet having the image formed on the first surface by the image forming unit is conveyed by the roller pair in a first direction. The time period from the time t2 to the time t3 illustrated in FIG. 5 or the time period from the time t3 to the time t4 illustrated in FIG. 7 is an example of a second time period in which the sheet is conveyed in a second direction different from the first direction by the roller pair. The CPU 201 controls the rotation speed of the motor 204 so that, at least in the first time period (in a part of the first time period), the sheet is conveyed at the second conveyance speed, which is lower than the first conveyance speed, from the first conveyance speed, which is a conveyance speed at which the sheet is conveyed in the image forming unit. As a result, it is possible to satisfactorily invert the sheet while reducing the size of the image forming apparatus 100.

Viewpoints 2 and 3

The second conveyance speed may be a conveyance speed determined so that the switching of the rotation direction of the roller pair by the switching unit and the transmission unit is completed when the trailing end of the sheet is conveyed at the conveyance position where the trailing end of the sheet can enter the sub conveyance path P2 while the sheet is pinched by the roller pair. That is, the second conveyance speed may be a conveyance speed determined so that the switching of the rotation direction of the roller pair by the switching unit and the transmission unit is completed before the trailing end of the sheet passes through the roller pair. As a result, the sheet with the second surface on which the image will be formed will be less likely to be accidentally discharged to the FD tray 112.

Viewpoint 4

After the sheet conveyance direction is changed from the first direction to the second direction, the CPU 201 returns the sheet conveyance speed from the second conveyance speed to the first conveyance speed. That is, after the sheet is successfully inverted, the sheet conveyance speed is increased. As a result, it will be easier to invert the sheet.

Viewpoint 5

The registration sensor 105 and the fixing discharging sensor 109 are examples of sensors provided upstream of the roller pair with respect to the sheet conveyance direction, and detect the sheet to be conveyed on the main conveyance path. The CPU 201 may reduce the sheet conveyance speed from the first conveyance speed to the second conveyance speed with reference to a time point at which the sensor detects the leading end or the trailing end of the sheet.

Viewpoint 6

As described in the first embodiment, the sensor (e.g., fixing discharging sensor 109) may be provided between the image forming unit and the roller pair. When the trailing end of the sheet passes the sensor, the CPU 201 may control the motor 204 to change the sheet conveyance speed from the first conveyance speed to the second conveyance speed.

Viewpoint 7

The sensor (e.g., fixing discharging sensor 109) may be a sheet sensor to confirm that the sheet has not jammed in the image forming unit. This will allow one sensor to be used for multiple purposes and reduce the number of sensors.

Viewpoint 8

The image forming unit may have a fixing unit (e.g., fixing device 130) that fixes a toner image on the sheet. In this case, the sensor may be a sheet sensor (e.g., fixing discharging sensor 109) to confirm that the sheet has not jammed in the fixing unit. This will allow one sensor to be used for multiple purposes and reduce the number of sensors.

Viewpoint 9

The sensor (e.g., registration sensor 105) may be provided upstream of the image forming unit in the sheet conveyance direction in the main conveyance path. The CPU 201 may control the motor 204 to change the sheet conveyance speed from the first conveyance speed to the second conveyance speed at a time point at which a first predetermined time period has elapsed since a time point at which the trailing end of the sheet passes the sensor.

Viewpoint 10

The sensor may be a sheet sensor (e.g., registration sensor 105) provided to determine when to start forming the image in the image forming unit. This will allow one sensor to be used for multiple purposes and reduce the number of sensors.

Viewpoint 11

The first predetermined time may be a time obtained by dividing a distance from the detection position of the sensor to the central position of the nip section of the fixing unit of the image forming unit by the first conveyance speed (e.g., Td).

Viewpoint 12

The CPU 201 may switch the sheet conveyance direction from the first direction to the second direction by switching the rotation direction of the roller pair with reference to the time point at which the sensor (e.g., fixing discharging sensor 109) detects the trailing end of the sheet.

Viewpoint 13

The CPU 201 may switch the rotation direction of the roller pair using a lapse of a second predetermined time period (e.g., Tb) as a trigger from the time point at which the sensor (e.g., fixing discharging sensor 109) detects the trailing end of the sheet. As a result, the sheet conveyance direction can be switched from the first direction to the second direction.

Viewpoint 14

The inversion sensor 113 is an example of a detection unit provided on the sub conveyance path P2 to confirm successful conveyance of the sheet to the sub conveyance path. The CPU 201 may return the sheet conveyance speed from the second conveyance speed to the first conveyance speed when the detection unit detects the leading end of the sheet. That is, after the inversion sensor 113 confirms that the sheet has been successfully inverted, the conveyance speed will be restored.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-032188, filed Feb. 27, 2020, which is hereby incorporated by reference herein in its entirety.

What is claimed is:

1. An image forming apparatus comprising:

a main conveyance path configured to convey a sheet;

an image forming unit configured to form images on a first surface and a second surface of the sheet to be conveyed on the main conveyance path;

a switchback unit provided at an end portion of the main conveyance path and configured to switch back the sheet having the image formed on the first surface by a roller pair;

a sub conveyance path configured to convey the switched back sheet to the main conveyance path in order to form the image on the second surface of the sheet;

a motor configured to be controlled to drive the roller pair provided in the switchback unit and to rotate in only one direction;

a transmission unit configured to transmit a driving force to be supplied from the motor to the roller pair;

a switching unit configured to act on the transmission unit to switch a rotation direction of the roller pair by the driving force between a normal rotation and a reverse rotation; and a control unit configured to control a rotation speed of the motor to convey the sheet, wherein the sheet having the image formed on the first surface by the image forming unit is conveyed in a first direction by the roller pair in a first time period, and the sheet is conveyed in a second direction different from the first direction by the roller pair in a second time period, the control unit changes the rotation speed from a first rotation speed to a second conveyance speed so that the sheet is conveyed at the second rotation speed in a part of the first time period, the second conveyance speed is lower than the first conveyance speed, and the first conveyance speed is a conveyance speed at which the sheet is conveyed in the image forming unit.

2. The image forming apparatus according to claim 1, wherein the second conveyance speed is a conveyance speed determined for completing switching of the rotation direction of the roller pair by the switching unit and the transmission unit when a trailing end of the sheet is conveyed at a conveyance position where the trailing end of the sheet may enter the sub conveyance path while the sheet is pinched by the roller pair.

3. The image forming apparatus according to claim 1, wherein the second conveyance speed is a conveyance speed determined for completing switching of the rotation direction of the roller pair by the switching unit and the transmission unit before a trailing end of the sheet passes through the roller pair.

4. The image forming apparatus according to claim 1, wherein after the sheet conveyance direction is changed from the first direction to the second direction, the control unit returns the sheet conveyance speed from the second conveyance speed to the first conveyance speed.

5. The image forming apparatus according to claim 1, further comprising:

a sensor provided upstream of the roller pair with respect to the sheet conveyance direction, and configured to detect the sheet to be conveyed on the main conveyance path, wherein the control unit reduces the sheet conveyance speed from the first conveyance speed to the second conveyance speed with reference to a time point at which the sensor detects a leading end or a trailing end of the sheet.

6. The image forming apparatus according to claim 5, wherein the sensor is provided between the image forming unit and the roller pair, and when the trailing end of the sheet passes the sensor, the control unit controls the motor to change the sheet conveyance speed from the first conveyance speed to the second conveyance speed.

7. The image forming apparatus according to claim 6, wherein the sensor is a sheet sensor to confirm that the sheet has not jammed in the image forming unit.

8. The image forming apparatus according to claim 6, wherein the image forming unit includes a fixing unit configured to fix a toner image on the sheet, and the sensor is a sheet sensor to confirm that the sheet has not jammed in the fixing unit.

9. The image forming apparatus according to claim 5, wherein the sensor is provided upstream of the image forming unit with respect to the sheet conveyance direction in the main conveyance path, and the control unit controls the motor to change the sheet conveyance speed from the first conveyance speed to the second conveyance speed at a time point at which a predetermined time elapses from a time point at which the trailing end of the sheet passes the sensor.

10. The image forming apparatus according to claim 9, wherein the sensor is a sheet sensor provided to determine a time point to start forming the image in the image forming unit.

11. The image forming apparatus according to claim 10, wherein the predetermined time is a time obtained by dividing a distance from a detection position of the sensor to a central position of a nip section of a fixing unit of the image forming unit by the first conveyance speed.

12. The image forming apparatus according to claim 5, wherein the control unit switches the sheet conveyance direction from the first direction to the second direction by switching the rotation direction of the roller pair with reference to a time point at which the sensor detects the trailing end of the sheet.

13. The image forming apparatus according to claim 12, wherein the control unit switches the sheet conveyance direction from the first direction to the second direction by switching the rotation direction of the roller pair using a lapse of a predetermined time period as a trigger from a time point at which the sensor detects the trailing end of the sheet.

14. The image forming apparatus according to claim 1, further comprising:

a detection unit provided on the sub conveyance path configured to confirm successful conveyance of the sheet to the sub conveyance path, wherein when the detection unit detects a leading end of the sheet, the control unit returns the sheet conveyance speed from the second conveyance speed to the first conveyance speed.

* * * * *